United States Patent [19]

Holzgruber

[11] 4,067,729

[45] Jan. 10, 1978

[54] DESULFURIZATION OF LIQUID IRON MELTS

[76] Inventor: Wolfgang Holzgruber, Westend 33, A-8600 Bruck (an der Mur), Austria

[21] Appl. No.: 719,599

[22] Filed: Sept. 1, 1976

[51] Int. Cl.[2] ..... C21C 7/04

[52] U.S. Cl. ..... 75/55; 75/58

[58] Field of Search ..... 75/55, 58

[56] References Cited

U.S. PATENT DOCUMENTS

| | | | |
|---|---|---|---|
| 3,172,756 | 3/1965 | Bengtsson | 75/55 |
| 3,396,010 | 8/1968 | Gould | 75/55 |
| 3,885,957 | 5/1975 | Richter | 75/58 |
| 3,929,464 | 12/1975 | Todd | 75/58 |
| 3,932,170 | 1/1976 | Shah | 75/58 |

*Primary Examiner*—Peter D. Rosenberg

*Attorney, Agent, or Firm*—Parmelee, Miller, Welsh & Kratz

[57] ABSTRACT

The present invention provides novel desulfurizing agents and a process for desulfurizing liquid iron melts and in particular pig iron melts in the temperature range of between about 1240° C to 1400° C by injecting into the melt, by means of a carrier gas, a prefused or sintered, granulated or pelletized desulfurizing agent comprising a calcium containing material having a liquidus temperature of less than about 1400° C.

17 Claims, No Drawings

DESULFURIZATION OF LIQUID IRON MELTS

DESCRIPTION OF THE PRIOR ART

During the past decades the requirements regarding the sulfur content in liquid iron melts have become more and more severe and will most probably continue to increase. Such iron melts are, for example, liquid pig iron used in the basic Bessemer or BOF-process or pig iron used for casting purposes such as white and grey cast iron or nodular cast iron.

The reasons for these requirements are the ever increasing demands in regard to the properties of various kinds of alloys which frequently can be met only when extremely low sulfur contents are obtained. A further reason for the demand of low sulfur contents in pig iron is due to the fact that the sulfur content is difficult to further decrease during the processing of pig iron to steel. The conversion of pig iron to steel is effected by an oxidizing treatment which, from a metallurgical standpoint, affords only limited possibilities for further desulfurization. It would therefore be desireable to control the sulfur content of the final alloy by controlling the amount of sulfur introduced during the steelmaking process. If this is not feasible, it may be possible to obtain the desired low sulfur contents by a post-treatment of liquid metal in the melt shop or foundry. Such treatment, however, is expensive and is disadvantageous in that the effect of the treatment cannot be effectively controlled unless a ladle degassing unit with auxiliary heating is available so that a sufficiently long holding time in the ladle is possible.

Lowering the sulfur content of the pig iron by changing the operating parameters of the blast furnace are also limited. Sulfur contents of less than about 0.04% can be obtained only when applying a highly basic slag which causes other disadvantages since the more basic the slag, the higher will be the liquidus temperatures of said slag. An increasing liquidus temperature of the slag, however, increases the coke consumption and reduces the output of the furnace. Furthermore, the highly basic slags will be more viscous at the temperature levels in the blast furnace which in turn will reduce their desulfurizing ability, so that an inordinately high percentage of slag would be required for adequate desulfurization.

Another problem is caused by the fact that the coke and other burden materials do not only introduce sulfur but also alkaline metals which are to be eliminated by the slag. An increase of alkaline metals in the blast furnace could destroy the furnace lining. The more basic the slag, however, the less is its ability to eliminate alkaline metals.

In order to avoid the inherent problems of a blast furnace operation with basic slag, frequently, neutral or acid slags are used, the lime to silica ratio of such slag being about 0.8 to 1.0. Under these conditions the amount of slag can be lower and its ability to extract alkalines is good. The application of neutral or acid slags therefore leads to an increased production together with a decrease in coke consumption and therefore results in lower operating costs. But, in this case sulfur content of the pig iron must be reduced by a desulfurizing treatment outside the blast furnace, which desulfurizing treatment of pig iron outside the blast furnace is a common processing step.

The present acceptable sulfur contents of pig iron are as low as 0.010% and it can be expected that values of 0.005% will be required before long. Such low sulfur contents, however, cannot be achieved without a separate desulfurizing treatment outside the blast furnace since desulfurization in the blast furnace itself is possible, at most, to only about 0.025%.

In principle, desulfurization of pig iron may be initiated at the earliest, immediately after tapping in the runners and at the latest just before beginning the oxidizing treatment for the steelmaking process, as desulfurization will be enhanced under reducing conditions and by a number of elements contained in the melt that are more readily oxidizable than iron. Thus far all post-desulfurizing processes have employed sodium or calcium compounds or metallic magnesium.

The treatment of liquid pig iron with metallic magnesium is carried out in ladles or torpedo ladles containing up to 200 metric tons and more. Such treatment is carried out by immersing magcoke into the liquid pig iron. Magcoke is produced by dipping superheated coke into liquid magnesium and contains approximately 45% metallic magnesium. During the immersion of magcoke in the pig iron the coke remains solid and swims up on the surface whereas the magnesium, depending on the depth of immersion and temperature of the pig iron, evaporates within about 8 to 15 minutes, thereby creating a boiling action i.e. the so-called "magnesium-boiling". The evaporating magnesium reacts with the sulfur in the pig iron melt forming $Mg_2S$ which floats up into the slag layer. By this treatment which up to now has been mainly used in the United States and Canada, sulfur contents of as low as 0.010% can be achieved with the time consumed being short and with only relatively small amounts of slag. However, the short life of the immersion equipment as well as a most probably forthcoming magnesium shortage are disadvantages of the method and the expense of the desulfurizing agent represents about ⅔ of the overall costs of the treatment.

Another desulfurizing treatment of liquid pig iron may be carried out by means of non-melting desulfurizing agents which react in the solid state, such as for example injecting or immersing calcium compounds such as powdered lime, technical calcium carbide, containing 80% $CaC_2$ or the like. These agents may be mixed with $CaCO_3$ which when dissociating during the treatment causes a better mixing of the metal with the desulfurizing agent. The powdered lime may be mixed with up to 10% soda in order to make the otherwise solid and dense lime slag spongy and more suitable for deslagging.

Desulfurization with nonmelting desulfurizing agents may be carried out, for example, in conventional ladles by mixing with a stirring device or by injecting with immersion lances. For treatment in torpedo ladles only injecting with immersion lances is possible. When using calcium carbide as a desulfurizing agent the danger of the formation of acetylene has to be considered where a humid atmosphere may be encountered. It is therefore most important to use dry carrier gases.

A continuous desulfurizing treatment is also possible and for this purpose it is usual to install a stirring ladle in the runner system of the blast furnace into which the desulfurizing agent is added.

In contradistinction to the above processes in a desulfurizing treatment of pig iron melts by addition of soda, a liquid desulfurizing slag is formed. The soda treatment can be carried out in the runner system or during the transportation of the pig iron from the blast furnace to the melt shop. Furthermore, the treatment can be carried out during the filling of the ladle from the mixer and can be filled into a second ladle for better mixing of pig iron. During transportation of pig iron in torpedo ladles no soda additions are possible in order to avoid a destruction of the ladle lining. A desulfurizing treatment with soda can be carried out easily and in a continuous way. The disadvantages of this kind of treatment, however, are the evaporation of soda which is highly undesirable when carrying out the treatment during tapping of the blast furnace. The evaporation losses at a pig iron temperature of about 1350° C are on the order of 35%. The treatment of hypoeutectic basic Bessemer iron is therefore carried out in the melt shop in a temperature range at which the alkaline-silicate slag stays sufficiently liquid. For hypereutectic basic pig iron there is only a narrow optimal temperature range for this type of treatment. At too high temperatures, the effect of the treatment is reduced due to the intensive evaporation of the soda. At too low temperatures, the slag will become crumbly and nonreactive due to the formation of kish graphite. Further disadvantages are the high reactivity of alkaline slags with the refractories as well as the comparably high price of the desulfurizing agent, which is approximately 3 to 4 times that of lime. In addition, the desulfurization effect and its reproducability are considered unsatisfactory.

During the development of the so-called slag reaction processes, basic Bessemer pig iron has also been treated with a lime-containing slag that is liquid in the temperature range of pig iron by which treatment also too high a silicon content had to be reduced. In basic steelmaking processes too high a silicon content prevents dephosphorization. For this reason silicon should be reduced by oxidizing agents such as iron or manganese oxides prior to the decarburizing period. A small content of about 0.2% Si, however, is desirable as desulfurization is promoted by the reducing effect of silicon. The oxidation of silicon, however, results in a high silica content of the slag which in turn reduces its ability to absorb sulfur so that excessive amounts of slag are required for the treatment.

In order to avoid slag melting in a separate slag melting furnace it was proposed to tap the pig iron into a ladle containing the constituents of the slag to be formed. In this case the constituents may be mixed in a powdered form or agglomerated.

The major part of the time available for the treatment in this case is lost in the formation of the slag. Moreover, when liquid slags are used it is difficult to obtain low sulfur contents by mixing of slag and metal in the ladle during tapping. A very short reaction time and a relatively limited reaction interface in comparison to the processes where the desulfurizing agents are introduced in a fine dispersed form are the reasons why the capacity of the slag to absorb sulfur is inefficiently used, with the effect being unpredictable.

All desulfurizing reactions which result in the formation of sulfides, such as MgS, CaS or $Na_2S$, can occur only at the interface of the metal-desulfurizing agent. The sulfur therefore will have to be transported to this interface by diffusion. The shorter the distances and the higher the temperature the faster mass exchanges by diffusion will occur. Short distances can be attained by introducing the desulfurizing agent in the form of a fine dispersion and by an intensive mixing with the metal.

Since the higher the rate of diffusion, the higher the temperature of the metal, desulfurizing immediately after tapping the blast furnace is preferable whereas desulfurization in the steel shop just before filling the vessel would seem unfavourable.

Therefore, as a practical matter, depending on the desulfurizing agent to be used, one has to make compromises so that in general the treatment is carried out between the blast furnace and the steel shop.

For a given rate of reaction, however, the mode of reaction of the desulfurizing agent is of importance which thus far frequently has been neglected.

When using magnesium, which is not soluble in iron, the desulfurizing agent is present in the form of gas bubbles rising in the melt whereby each of the bubbles can react with the metal in forming solid MgS until it reaches the surface of the metal. Under ideal conditions the whole of the bubble would have been consumed before reaching the metal surface and would have been completely converted into MgS. The so called magnesium boiling, however, indicates that these ideal conditions are not attained. It is therefore realistic to consider that the bubble formed within the bulk metal will be surrounded by solid magnesium sulfide when sufficient sulfur is present in the metal. Thereby the reaction interface for the mass exchange will change from Mg-gas -bubble/metal to Mg/gas-bubble/solid MgS. The sulfur now has to diffuse through the solid MgS-layer before it can react with Mg-vapor. For the further reaction, diffusion in the solid state will be rate determining which represents a much slower step compared with diffusion in the liquid state. From a certain thickness of the layer of MgS on, no further mass exchange can be expected as the reaction time is limited by the time the gas bubbles remain within the metal. By the solid sulfides formed, the total reaction interface will be reduced while also the sulfur content of the metal is reduced. The solids sulfides formed float up into the slag layer on top of the metal thus stiffening the slag layer. Together with the reduction of the interface and the sulfur content the distances to be overcome by diffusion in the liquid phase become longer. For these reasons desulfurization is more and more hindered by the formation of solid sulfide layers and will finally come to a standstill.

In principle similar conditions exist when non-melting desulfurizing agents are used, such as calcium compounds. In this case desulfurization occurs by the formation of solid layers of CaS at the surface of the solid particles. The reaction interface for desulfurization which originally had been the interface between the solid particle of the desulfurizing agent and the metal will then change to solid particle/solid calcium sulfide. The possibilities for further desulfurization through the solid CaS-layer which had to occur by diffusion in the solid state seem to be even more limited than with the Mg-treatment.

Although desulfurization by means of metallic Mg and solid Ca-compounds represent processes ready for industrial application with satisfactory results at reasonable costs it is necessary to reconsider the problem of desulfurization of pig iron between blast furnace and steel plant in regard to its technological and economic aspects bearing in mind the ever increasing demands in steel quality.

OBJECTS OF THE INVENTION

The present invention is based on the concept that a desulfurizing agent can only be really suitable when, during the desulfurizing reaction, the formation of solid sulfide layers can be avoided. The principal object of the invention is therefore that of maintaining the desulfurizing agent in the form of small droplets of liquid slag that are dispersed in the liquid metal which will dissolve and dilute the respective sulfide formed at the interface between liquid metal and droplet, enabling a more complete desulfurization up to the solubility of the said slag as long as the reaction time is sufficient. The reaction time, however, should be definitely longer in the case of an emulsion between slag and metal as compared to a simple mixing obtained by the slag reaction processes.

A further consideration is that the desulfurizing agent should be as inexpensive as possible in order to enable desulfurization to extremely low sulfur contents for which larger amounts are required at reasonable cost.

The treatment with soda, where desulfurization occurs with a liquid slag, is not suitable for this purpose. The best basis for a high rate of reaction certainly exists when the pig iron temperatures are as high as possible. When reconsidering the desulfurization of pig iron melts it would certainly be erroneous to omit the advantages of a high temperature of the pig iron immediately after tapping the blast furnace, which would be necessary when applying soda, as temperatures above 1250° C. and even more so above 1300° C. result in intolerable evaporation losses together with the formation of annoying fumes.

It is therefore preferable to use CaO-containing desulfurizing slags as they have been used at the even higher temperatures of steel melts in the application of slag reaction processes. The disadvantages of this process as discussed hereinabove are avoided when using the process according to the invention.

DESCRIPTION OF THE INVENTION

In order to achieve positive results a desulfurizing agent must be such to enable the formation of a liquid highly reactive slag in the temperature range of between 1240° C. and 1400° C. and by injecting the desulfurizing agent in a pulverized form by means of a carrier gas into the liquid pig iron melt and by melting of said pulverized particles in said melt the slag droplets necessary for desulfurization are formed. The smaller the particles are, the faster they will melt and the larger will be the available reaction interface. For these reasons, the size of the particles should not exceed 5 mm, preferably 3 mm. Too small a particle size is also not suitable as the small particles may be carried out again by the carrier gas. Furthermore, the possibility exists that too small particles, especially when using a humid carrier gas, may agglomerate to larger lumps which would prevent the introduction of the desulfurizing agent in a fine dispersed form in order to obtain an as larger possible reaction interface. It has been determined therefore that the lower limit of particle size be not less than about 0.001 mm.

Desulfurizing agents which are suitable for the purpose of this invention contain by weight between 10% and 60% CaO and at least two additional slag-forming components and have a liquidus temperature of less than about 1400° C. The particles injected into the melt become effective in the desired manner only if they already contain all constituents required for slag formation. It is therefore not sufficient just to inject a physical mixture of the ground components as they will come into close contact for slag formation only accidentally and whether slag droplets will be formed inside the melt will more depend on chance. For the production of a desulfurizing agent for the purpose of this invention it is therefore necessary to first melt the individual constituents into a slag, cast or granulate with water or at least to grind the single components, mix them and form pellets of said mixture which are sintered and to finally grind the molten or sintered products to the desired particle size.

Slag-forming compositions which are liquid in the temperature range of liquid pig iron and which have a good desulfurizing ability are well known to the art.

Thus, the invention provides a process for the desulfurization of pig iron melts in a temperature range of between 1240° C and 1400° C by injecting Ca-containing solid particles by means of a carrier gas and the invention comprises the injection of a prefused or presintered desulfurizing agent, said desulfurizing agent having a liquidus temperature of less than about 1400° C and the grain size of said desulfurizing agent being less than 5 mm, preferably less than 3 mm but not less than 0.001 mm and said desulfurizing agent comprising about 10% to 60% by weight of CaO and at least two other components suitable for slag formation, in order to form a fine dispersion of said desulfurizing agent within a matrix of the pig iron melt.

Suitable known components for slag formation are for example $Al_2O_3$, $CaF_2$, $SiO_2$, MgO, $Na_2O$ and heavy metal oxides, especially iron- and manganese-oxides. Components containing $Al_2O_3$ up to 40% by weight, $CaF_2$ up to 70% by weight, $SiO_2$ up to 20% by weight, MgO up to 10% by weight, $Na_2O$ up to 40% by weight and heavy metal oxides up to 20% by weight are preferably used.

Preferably these components are chosen such that the liquidus-temperature of the desulfurizing agent is at least 100° C less than the temperature of pig iron melt to be treated.

When producing the desulfurizing agent sulfur may be introduced by the raw materials. Thus care must be taken to assure that the sulfur content be as low as possible and should not in any event exceed 0.5% by weight, since sulfur introduced by way of the desulfurizing agent reduces the capability of the slag droplets to absorb sulfur from the pig iron melt. When considering these restrictions sintered or molten products or wastes can be used as raw materials if they contain CaO and further constituents suitable for slag formation. Such raw materials are available at very low cost.

One example is represented by cement clinker which has a melting point of about 2000° C and contains approximately 64% by weight CaO, 25% by weight $SiO_2$, 4% by weight $Al_2O_3$, 1 to 2% by weight $Fe_2O_3$ and 0.2 to 0.4% by weight S. By melting or sintering said cement clinker together with additions of for example $Al_2O_3$ or $CaF_2$ it is possible to obtain products with a liquidus temperature of less than 1400° C and with a content of less than 60% CaO and less than 20% $SiO_2$ so that after the grinding of said products desulfurizing agents according to the invention are obtained.

Another example is represented by the slags obtained in the production of ferrovanadium which are a cheap wasteproduct with a melting point of about 1400° C and which are sometimes used as fluxing agents for refining slags in electric arc furnaces. Such FeV-slags contain approximately 45% by weight CaO, 45% by weight $Al_2O_3$ as well as small amounts of heavy metal oxides, MgO and $SiO_2$. By fusing or sintering said lime-alumina-slag together with additions by which the $Al_2O_3$-content is decreased to less than 40% by weight and by which the liquidus temperature is further decreased it is also possible to obtain a desulfurizing agent with the desired properties.

Also suitable are the lime-aluminia-silica-slags having a melting point of about 1350° C which are a waste-product in the production of low carbon ferromanganese and extremely low in price. They contain about 40% by weight CaO, 30% by weight $SiO_2$ and 30% by weight $Al_2O_3$. When processing these slags in the described manner one can lower the $SiO_2$-content to less than 20% and obtain low-priced desulfurizing agents.

Suitable additives for the reduction of the liquidus temperature are for example the comparably inexpensive melt shop grade fluorspar with a melting point of 1290° C or the even lower melting soda. Soda has a melting point of about 850° C and even small additions represent a very effective fluxing agent.

The carrier gas, besides being used to inject the desulfurizing agent into the metal, also has the important function of intensively mixing the slag droplets formed with the metal in order to increase the size of the reaction interface and to reduce the distances for diffusion. Thus mixing will be the more intensive the more carrier gas per kilogram of desulfurizing agent is used, the deeper the lance is submerged into the metal and the higher the pressure of the carrier gas at the spout of the lance. The desired reduction of the distances for diffusion will be the more important, the lower the initial sulfur content of the metal and the lower its temperature is, as the rate of diffusion will be reduced with decreasing temperature.

The amount of desulfurizing agent to be injected into metal depends on the required desulfurization and in general will be on the order of about 0.5% to 2% by weight of the weight of the metal treated.

With the process according to the invention the desulfurizing agent will be utilized much better as with the injection and mixing processes according to the state of the art where calcium compounds are used which react and remain in the solid state.

The carrier gas can be loaded with about 25 to 300 grams of desulfurizing agent per liter of gas. The burden of the carrier gas is chosen according to the geometry of the vessel, the quantity of pig iron melt and the initial sulfur content of the pig iron melt to be treated.

Suitable carrier gases are for example compressed air, or preferably inert gases such as argon or nitrogen either singly, or together. Reducing gases such as natural gas or the like may also be used.

Compressed air may be used when the basicity of the slag and the silicon content of the metal are high and when a high burden of the carrier gas is used i.e. that the amount of air is comparably small so that the oxygen of the air which is counteracting the desulfurizing reaction remains practicably ineffective. Pig iron melts in comparison to steel melts have high carbon and usually also high silicon contents resulting in a low oxygen activity of the metal which represents an important prerequisite for desulfurization.

The pressure of the carrier gas should be at least 4 atmospheres, preferably about 7 to 19 atmospheres. At the spout of the lance, however, only a lower pressure becomes active due to ferrostatic pressure in the melt and the pressure losses in the pneumatic system. The flow rate of the carrier gas is preferably between about 1 to 20 cubic meters per minute with the lance orifice having a diameter of preferably between about 10 to 65 mm.

In exceptional cases it is also possible to inject fluxing agents together with the desulfurizing agent. Though this may not be of immediate effect, as discussed before, it still can be of advantage if the slag formed on top of the pig iron melt can react again, for example, when dipping the metal together with the slag into a second ladle. These fluxing agents, in particular fluorspar and soda, can also be added to the slag formed on top of the metal, when sufficient time is available for melting.

With very low silicon contents of the metal which in exceptional cases may occur it can be of advantage to also inject a deoxidizing agent together with the desulfurizing agent, such as Al-powder, FeSi-powder or the like.

The known method of a continuation of injection of the carrier gas without any desulfurization agent for a further mixing of slag and metal in general is not required to carry out the process according to the invention, however, if desired, this "afterblowing" step may be carried out. This afterblowing treatment usually becomes effective not before 5 minutes and is of no further effect after 15 minutes. An afterblowing treatment of more than 15 minutes only results in a temperature loss of the melt.

The process according to the invention also contemplates injecting together or one after the other prefused or sintered desulfurizing agents of the same or of a different composition, with the same or different liquidus temperature, and if occasion arises with further additions, into the pig iron melt as well as the further possibility to vary the burden and simultaneously or separately the pressure of the carrier gas during the injection treatment.

The purpose of such modes of operation can be derived from the above, if one considers that during the injecting treatment the sulfur content of the pig iron melt and its temperature decrease continuously. Furthermore, the silicon content of the metal may decrease if the desulfurizing agent contains heavy metal oxides.

What is claimed is:

1. A process for the desulfurization of pig iron melts having a temperature in the range of between about 1240° C. to 1400° C. comprising forming a desulfurizing liquid slag emulsion in the melt by injecting into the melt, by means of a carrier gas, an agglomerated desulfurizing agent said desulfurizing agent having a liquidus temperature of less than about 1400° C., a particle size of less than about 5.0 millimeters and comprising between about 10 and 60 percent by weight of calcium oxide with the balance comprising at least two other slag-forming constituents, selected from the group consisting of $Al_2O_3$, $CaF_2$, $SiO_2$, MgO, $Na_2O$ and heavy metal oxides; and wherein $Al_2O_3$ may be present in an amount up to 40 percent by weight, $CaF_2$ up to 70 percent by weight, $SiO_2$ up to 20 percent by weight, MgO up to 10 percent by weight, $Na_2O$ up to 40 percent by weight; and heavy metal oxides up to 20 percent by weight.

2. The process of claim 1 wherein the desulfurizing agent has a particle size of between about 0.001 millimeters and 3.0 millimeters.

3. The process of claim 1 wherein the liquidus temperature of the desulfurizing agent is about 100° C. lower than the temperature of the melt.

4. The process of claim 1 wherein the amount of desulfurizing agent injected into the melt is from about 0.5 percent to about 2.0 percent by weight based on the weight of melt to be desulfurized.

5. The process of claim 4 wherein the amount of desulfurizing agent contained in the carrier gas is from about 25 grams to 300 grams per liter of carrier gas.

6. The process of claim 5 wherein the carrier gas containing the desulfurizing agent is injected into the melt at a pressure of at least 4 atmospheres and at a flow rate of between about 1 to 20 cubic meters per minute.

7. The process of claim 6 wherein the injection pressure is from about 7 to about 19 atmospheres.

8. The process of claim 1 wherein the carrier gas is selected from the group consisting of compressed air, an inert gas or a reducing gas.

9. The process of claim 8 wherein the inert gas is argon or nitrogen and the reducing gas is natural gas.

10. The process of claim 1 wherein a fluxing agent or a mixture of fluxing agents are injected into the melt together with the desulfurizing agent.

11. The process of claim 10 wherein the fluxing agent is agglomerated along with the remaining constituents of the desulfurizing agent prior to injection into the melt.

12. The process of claim 1 where a deoxidizing agent or mixture of deoxidizing agents are injected into the melt together with the desulfurizing agent.

13. The process of claim 1 wherein the injection of carrier gas into the melt is continued for about 5 to 15 minutes after the desulfurizing agent has been injected.

14. A desulfurizing composition for use in desulfurizing liquid pig iron melts in the temperature range of between about 1240° C. to 1400° C. comprising a fused, granulated composition containing between about 10 and 60 percent by weight of calcium oxide with the balance of the composition comprising at least two other slag-forming constituents, selected from the group consisting of $Al_2O_3$, $CaF_2$, $SiO_2$, MgO, $Na_2O$ and heavy metal oxides; and wherein $Al_2O_3$ may be present in an amount up to 40 percent by weight, $CaF_2$ up to 70 percent by weight, $SiO_2$ up to 20 percent by weight, MgO up to 10 percent by weight, $Na_2O$ up to 40 percent by weight and heavy metal oxides up to 20 percent by weight, said composition having a liquidus temperature of less than about 1400° C. and a particle size of less than about 5.0 millimeters.

15. The desulfurizing composition of claim 14 having a particle size of between about 0.001 millimeters and 3.0 millimeters.

16. The desulfurizing composition of claim 14 having a liquidus temperature about 100° C. lower than the temperature of the pig iron melt.

17. The desulfurizing composition of claim 14 containing at least one slag-forming fluxing agent.

* * * * *